United States Patent [19]

Bianchi et al.

[11] Patent Number: 4,740,106

[45] Date of Patent: Apr. 26, 1988

[54] IMPRESSED CURRENT CATHODIC PROTECTION OF OFF-SHORE PLATFORMS UTILIZING THE TENSIONED ANODE ROPES SYSTEM

[75] Inventors: Giuseppe Bianchi, Milan; Gian L. Mussinelli, Lomazzo; Bruno Bazzoni, Milan, all of Italy

[73] Assignee: Oronzio deNora S.A., Lugano, Switzerland

[21] Appl. No.: 14,808

[22] Filed: Feb. 13, 1987

[30] Foreign Application Priority Data

Mar. 10, 1986 [IT] Italy ..... 19686 A/86

[51] Int. Cl.[4] ..... E02B 17/00; C23F 13/00

[52] U.S. Cl. ..... 405/211; 204/147; 204/197; 405/224

[58] Field of Search ..... 405/195, 211, 224; 204/147, 196, 197

[56] References Cited

U.S. PATENT DOCUMENTS

| | | | |
|---|---|---|---|
| 2,496,532 | 2/1950 | Gross | 405/224 |
| 3,717,001 | 2/1973 | Tam | 405/224 X |
| 4,089,767 | 5/1978 | Sabins | 405/211 X |
| 4,484,839 | 11/1984 | Nandlal et al. | 405/211 |

*Primary Examiner*—David H. Corbin

*Attorney, Agent, or Firm*—Bierman & Muserlian

[57] ABSTRACT

The present invention concerns a system for cathodic protection of off-shore structures, by the impressed current method, which system comprises tubular anode assemblies (1, 1') coaxially applied onto power supply cables (4), supported by ropes (5) tensioned between anchoring bodies (15) and the structure to be protected (17) or directly supported by the structure to be protected. The tubular anodes, the relevant hydraulic sealings and electrical connections and the power supply cables (4) are not subjected to the mechanical stresses affecting the support.

5 Claims, 6 Drawing Sheets

IMPRESSED CURRENT CATHODIC PROTECTION OF OFF-SHORE PLATFORMS UTILIZING THE TENSIONED ANODE ROPES SYSTEM

The present invention relates to a system for cathodically protecting against corrosion steel structures immersed in sea water, by the impressed current method. The system according to the present invention comprises an anodic assembly, consisting of anodes and the relevant electrical connections, and a support for bearing the anodic assembly itself. The present invention is particularly suitable for cathodically protecting offshore structures, and more particularly for cathodically protecting fixed steel platforms when retrofitting upon exhaustion of the cathodic protection system originally provided is required, not only in the case of impressed current systems but also in the case of sacrificial anodes.

However, it is to be intended that the system according to the present invention may be utilized for cathodic protection of new platforms or any other steel structure operating in sea water or different aqueous environments.

Retrofitting of cathodic protection systems applied to steel structures in sea water may become necessary for a number of possibilities:

(1) The cathodic protection system to be substituted is constituted by sacrificial anodes whose weight had been defined, during the engineering phase, on the basis of the expected lifetime for the structure to be protected, its surface area and the protection current density. If the actual protection current density is higher than the calculated one, the anode consumption rate results higher than that foreseen and therefore the structure becomes unprotected before the planned lifetime expires. The same applies to the case of a structure whose surface is increased with respect to the projected value due to the addition of overstructures not foreseen while calculating the weight of the sacrificial anodes. Another possibility, (which may apply to many structures having the same age installed in the same field) is that the active life of the wells is extended for an unexpected potentiality of the oil-field or due to improved recovery techniques.

(2) During the engineering of working phase of the cathodic protection system, faults occurred whereby the structure or part of the structure remains outside the protection condition from the beginning or anyway before the term foreseen by the project.

(3) The cathodic protection system, especially when based on impressed currents, undergoes a broad damage which cannot be repaired by a simple maintainance service.

The first case considered above is rather common, may be easily foreseen and necessity of retrofitting occurs after a period of time which represents an important portion of the expected lifetime. The second and the third ones are rather aleatory and may take place also soon after installation and therefore on site retrofitting results unavoidably.

Retrofitting operations are particularly troublesome and expensive when installation of new sacrificial anodes is considered, involving the necessity to resort to divers and boats. The cost is remarkably increased when these operations are to be effected in deep waters. For these reasons, substitution of exhausted sacrificial anodes by installing new sacrificial anodes may be considered as economically acceptable only in case of shallow waters.

Retrofitting of impressed current permanent anodes results less troublesome due to the lower number of permanent anodes to be applied onto the structure and to the fact that no welding operations are required underwater.

Furthermore, the installation problems are considerably reduced by positioning the permanent anodes at a certain distance from the structure to be protected, for example by supporting said anodes by means of ropes connected to anchoring bodies lying onto the sea bottom. This system, defining as "tensioned ropes system", substantially consists of one or more tensioned supporting elements, for example ropes acting as a mechanical support for the anode assembly, which comprises power supply cables and permanent anodes. Said tensioned ropes may be of steel, usually protected by an insulating sheath made for example of polyurethane, Teflon, Hypalon or PVDF. Also non-metal ropes may be used, such as for example made of polyester, Kevlar or similar materials. Tubular anodes, preferably of the inert type are applied onto said rope by means of suitable elements which provide for the mechanical connection, and electric insulation of the connection between the anodes and the power supply cable. The tensioned supporting ropes are connected to a fixed point onto the platform while the load may be applied by means of a turnbuckle or lever or pulley or counterweight or the like. This system avoids the need for divers for its installation, also in case of deep waters.

A further advantage offered by utilizing an impressed current cathodic protection system is represented by its active lifetime which is theoretically unlimited and practically very long.

On the other end, the "tensioned ropes system" is affected by a severe shortcoming regarding the connection between the anode, the power supply cable and the supporting ropes. In fact, said connection according to the prior art teachings is effected by utilizing cast resins, applied also under pressure, which form a rigid block onto the supporting rope, and consequently the mechanical stresses due to the tensioning of the rope and to the variations of strain due to the action of sea waves and currents are unavoidably discharged onto said rigid block. Therefore the risk exists that cracks in the resin block allow for sea water seepage and once the anode-cable connection gets in contact with the sea water the copper conductor is readily corroded and the corresponding anode is consequently inactivated. A possible shortcircuit between the power supply cable and the supporting rope readily causes corrosion of the metal rope with the consequent break-down and destruction of the entire portion of the cathodic protection system anchored to the rope itself.

It is an object of the present invention to overcome the aforementioned shortcomings of conventional cathodic protection systems and particularly of cathodic protection systems which utilize supporting tensioned ropes.

The present invention comprises a permanent anodic structure having a large linear extrusion constituted by one or more power supply electrically insulated cables, whereto tubular anodes are coaxially and electrically connected.

Particularly suitable for use according to the present invention is the anodic structure produced by the applicant under the Trademark LIDA(R) (see U.S. Pat. Nos.

4,452,683 and 4,526,666). However, it is obvious that different types of permanent structures exhibiting a linear extension may be utilized, wherein the electrical connection and the sealing between the tubular anodes and the power supply cable may be of various types (see, besides the above U.S. Pat. Nos. 4,452,683 and 4,526,666, also European Patent Publication No. 0 195 982 A by the applicant).

It is obvious for those skilled in the art that the supporting structure may be constituted also by the metal structure to be protected.

More particularly, the cathodic protection system by impressed current according to the present invention comprises:

(a) a permanent anode assembly having a linear extension constituted by one or more power supply cables whereto tubular anodes are coaxially and electrically connected; and (b) a mechanical support constituted by tensioned ropes or by the structure to be protected itself, and it is characterized in that the anodic assembly is mechanically connected to the support by means of a first mechanical fastening element to fix the cable at one end of each anode, leaving a certain distance between the anode and the support itself, a portion of said cable before said fastening element being loose, as well as a portion of the cable after the anode at the opposite end with respect to the first fastening element, additional ties being provided if necessary to fasten to the support the portions of the power supply cable interconnecting the anodes.

According to the present invention the drawbacks of the prior art technique are overcome and the mechanical stresses overloading the connections of the anodes with the power supply cable are eliminated.

According to another embodiment of the present invention the anodic structure is mechanically connected to the support by a second fastening element connecting the cable to the support in proximity of the other anode end opposite to the end close to the first fastening element, said second fastening element allowing the cable to slide along the direction defined by the axis of the support.

The invention will be hereinbelow described making reference to some embodiments thereof, which are intended only to illustrate the invention and not to limit the same. Referring to the figures:

FIG. 1 is a view of a typical element of the cathodic protection system of the present invention;

FIGS. 2*a* and 2*b* show a magnified, transversal cross sectional view and and a magnified longitudinal view of a typical fastening element between the anodic structure and a supporting rope.

Figure 1:
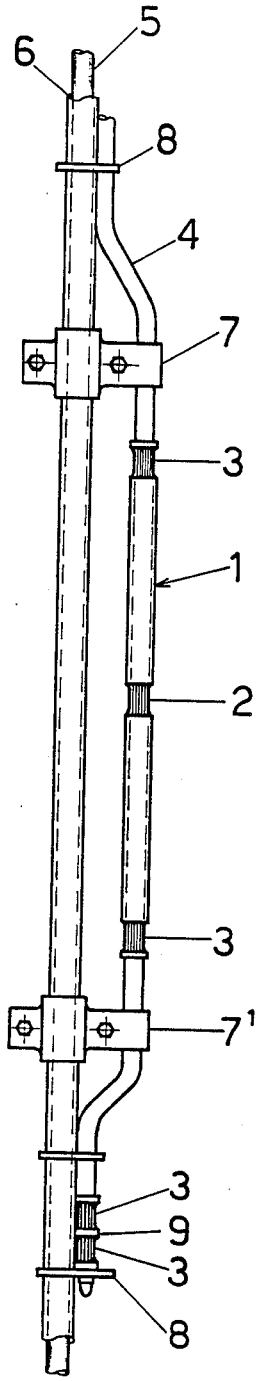

In FIG. 1, the tubular anodic assembly 1, made of titanium or other valve metal, activated by platinum or noble metal oxides, is coaxially applied onto electric cable 4, the electrical connection and the hydraulic sealing being provided by plastically deforming the tubular anode inwardly, respectively at points 2 and 3, as described in U.S. Pat. No. 4,526,666. However, it is obvious that said electrical connections and sealings may be effected by any other different method known to those skilled in the art (see for example Italian patent application No. 19877 A/85 - European Patent Publication 195 982 of Oct. 1, 1986).

The cable-anode assembly is supported by rope 5, made of steel or other suitable material, also a non metallic material, which rope may be protected by an insulating sheath 6. The fastening elements 7 and 7′ mechanically connect cable 4 to rope 5 while keeping cable 4 some centimeters spaced apart from rope 5 in order to limit the shielding effect onto the anode and avoid chlorine evolution onto the supporting rope. The portion of the power supply cable 4 free of anode assemblies is preferably helically wound onto the supporting rope 5 and fastened thereto by means of ties 8, avoiding thus that the mechanical stresses due to the supporting rope 5 affect the power supply cable 4.

Figure 2A:
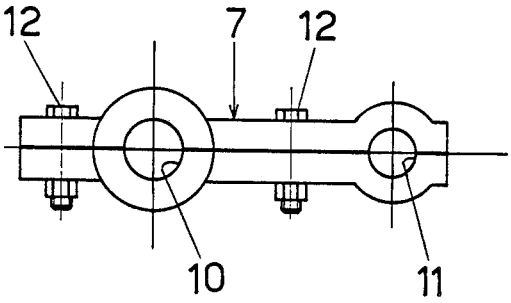
Figure 2B:
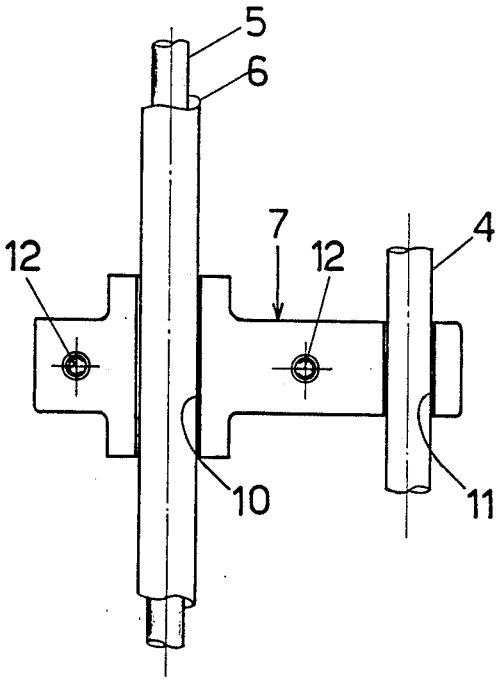

The power supply cable 4 may be provided with a cap 9 at one end thereof applied onto the cable by plastic inward deformation, the cable being fastened to the rope by means of ties 8. At the other end of the cable a further anode assembly may be applied as described above. The fastening elements 7 and 7′, the ties 8 and the insulating sheath 6 applied onto rope 5, at least for the portion in correspondence of the anode assembly, are made of chlorine-resistant materials (for example Teflon or PVDF). In a preferred embodiment of the present invention the fastening element 7 (FIGS. 2*a* and 2*b*) may be for example constituted by two clamping elements exactly mating and defining housing 10, for the rope 5 and sheath 6, and housing 11 for the power supply cable 4.

The two halves forming the fastening element 7 are then assembled by means of bolts 12 in order to fix the electric cable 4 to rope 5.

The only difference between fastening element 7 and 7′ consists in the fact that the fastening element 7′ provides for a slightly larger diameter of the housing 11 with respect to the diameter of cable 4 and thus cable 4 may slide inside housing 11 along the direction defined by the longitudinal axis of rope 5.

Obviously, the fastening elements 7 and 7′ between the cable 4 and the rope 5 may be also provided so as to house more than one cable fixed onto the supporting rope, the other cables feeding other anodes or series of anodes. In this case the fastening elements 7 and 7′ have a circular shape with the required number of housings 11 for the cables 4 distributed along their circumferences.

By means of the fastening elements 7 and 7′ and also due to the fact that the portion of cable 4 before said connection is maintained loose, the anode 1 as well as cable 4 and the relevant connections are not subjected to any mechanical stresses or variations of the restraint forces acting onto the supporting rope 5.

In a particularly simplified embodiment of the present invention the fastening elements 7 and 7′ are constituted by a simple tie or clamp or the like, one of which (7′) is not completely tightened.

Figure 3:
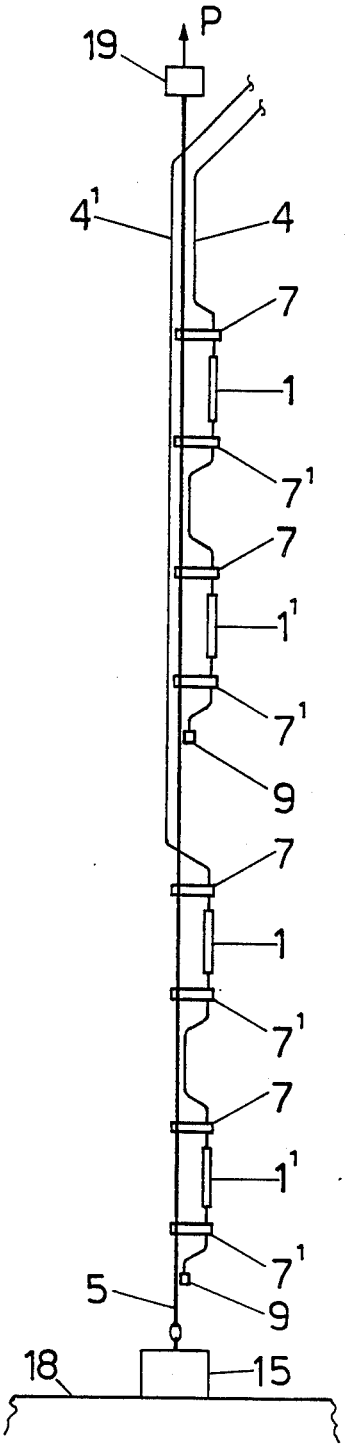
FIG. 3 is a schematic view of an embodiment of the cathodic protection system of the present invention.

FIG. 3 shows a cathodic protection system as above illustrated: the supporting rope 5 is tensioned by load P between the anchoring body 15 lying onto the sea bottom and a suitable device 19 (turnbuckle, lever or the like) fastened onto the structure to be protected; two anodic power supply cables 4 and 4′ are assembled (helically wound and fastened) onto rope 5 by means of fastening elements 7 and 7'. A sealing cap 9 is provided at the end of each cable.

The number of anode assemblies fastened to each rope as well as the number of anodes applied onto each cable may be suitably varied.

Figure 4:
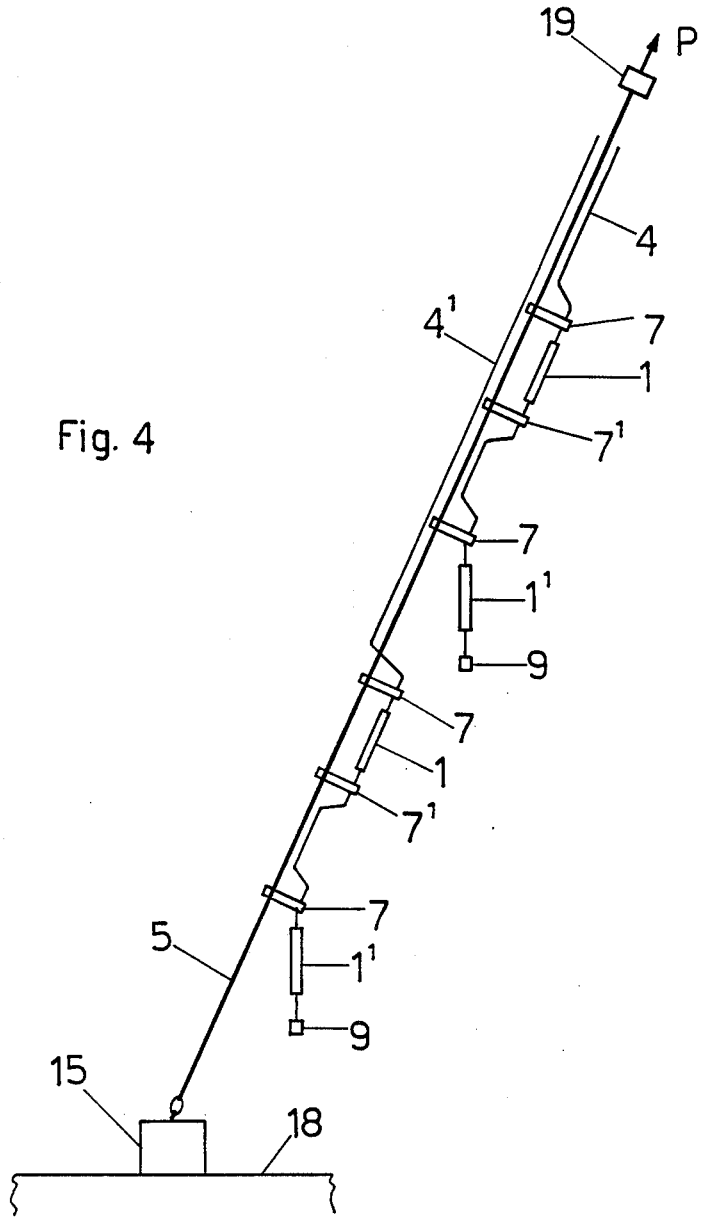
FIG. 4 is a schematic view of a further embodiment of the present invention.

FIG. 4 shows another embodiment of the cathodic protection system according to the present invention wherein anodes 1 are fastened to rope 5 as above described, that is by means of fastening elements 7 and 7' while anodes 1' are fastened to rope 5 by means of fastening element 7 only, the other end of anodes 1' remaining loose.

Figure 5:
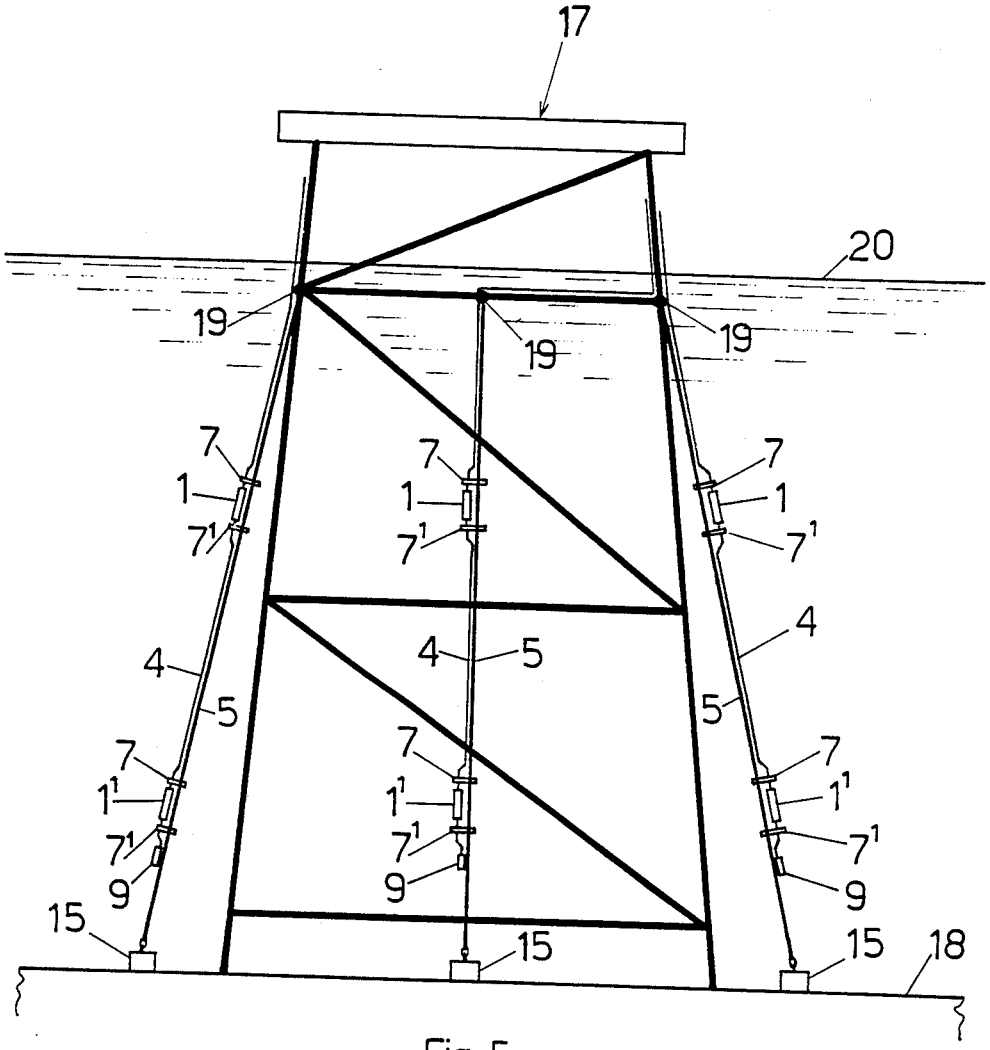
FIG. 5 is a schematic view of a cathodic protection system according to the present invention as applied to a typical off-shore structure.

FIG. 5 schematically illustrates a cathodic protection system provided with tensioned ropes applied onto an off-shore platform 17. Onto the sea bottom 18 around the platform 17 lay the anchoring bodies 15 wherefrom the tensioned ropes 5 are departing and anchored to the platform structure at position 19 by a turnbuckle or lever device. The sea surface is indicated by numeral 20.

The power supply cable 4 and the anode 1 are applied onto the tensioned ropes, as illustrated in detail in FIG. 3.

Launching and tensioning of the rope may thus be effected from the surface to any depth.

Figure 6:
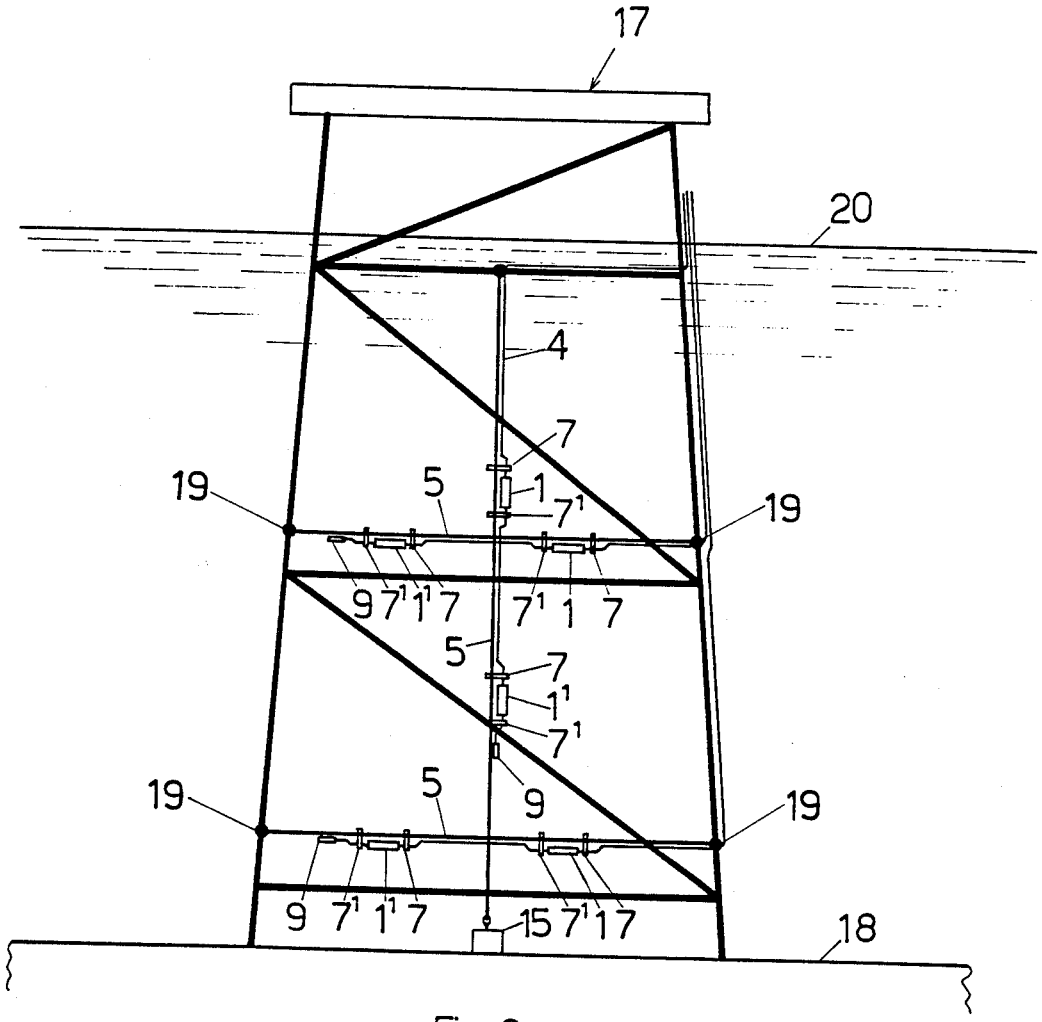
FIG. 6 shows a further embodiment of the present invention applied to the same off-shore structure of FIG. 5.

FIG. 6 shows a different embodiment of the present invention wherein the rope 5 is vertical to the platform while portions of said rope are horizontally tensioned between anchoring points 19 in order to support a higher number of anodes 1 in the zones of the structure geometrically complicated to be protected and requiring for a higher protection current density.

It is obvious for those skilled in the art that for protecting, in shallow waters, off-shore structures having a suitable geometry, the anode assembly may be directly supported by the structure to be protected itself, provided that fastening of the the anode assemblies to the structure is effected as illustrated in the preceding description. In this case, it is possible to avoid the use of tensioned ropes.

We claim:

1. A cathodic protection system, by impressed current, for steel structures immersed in sea water, which comprises:

(a) a permanent anode assembly having a linear extension constituted by one or more power supply cables (4) whereto tubular anodes (1, 1') are coaxially and electrically connected to the power supply cable; and (b) a mechanical support constituted by tensioned ropes (5) or by the structure to be protected itself (17);

said cathodic protection system being characterized in that the anodic structure is mechanically connected to the support (5, 17) by means of a first mechanical fastening element (7) which fixes the cable (4) in proximity of one of the anode ends, leaving a certain distance between the anode and the support itself, a portion of said cable (4) before said fastening element (7) being loose as well as the portion of the cable after the anode (1, 1') at the end opposite to that one wherein the first fastening element (7) is provided, additional clamps (8) being provided if necessary to fasten to the support (5, 17) the portions of cable (4) interconnecting the anodes (1, 1').

2. The cathodic protection system of claim 1, characterized in that the anode assembly is mechanically connected to the support (5) by means of a second mechanical fastening element (7') in proximity of one end of all or part of the anodes (1, 1') opposite to the end close to the first fastening element (7), said second fastening element (7') allowing the cable (4) to slide along the direction defined by the longitudinal axis of the support (5).

3. The cathodic protection system of claim 1, characterized in that the first fastening element (7) and the a second fastening element (7') for fixing the anode assembly to the support (5, 17) have a circular shape with the required number of housings 11 for the cables 4 distributed along their circumferences.

4. The cathodic protection system of claim 1, characterized in that the supports (5) whereto the anode assembly is fastened, are tensioned between anchoring bodies (15) lying on the sea bottom (18) and tensioning devices (19), consisting of a turnbuckle, or a lever and counterweight or the like, fixed onto the structure (17) to be cathodically protected, or otherwise said supports (5) are suspended from a fixed point of the structure to be protected (17).

5. The cathodic protection system of claim 2, characterized in that the first fastening element (7) and the second fastening element (7') for fixing the anode assembly to the support (5, 17) have a circular shape with the required number of housings (11) for the cables (4) distributed along their circumferences.

* * * * *